US006486613B2

(12) United States Patent
Franck et al.

(10) Patent No.: US 6,486,613 B2
(45) Date of Patent: Nov. 26, 2002

(54) REDUCING THE CLAMPING VOLTAGE OF OPERATING DEVICES FOR GAS DISCHARGE LAMPS

(75) Inventors: Felix Franck, Munich (DE); Markus Heckmann, Munich (DE)

(73) Assignee: Patent-Treuhand-Gesellschaft fuer Elecktrische Gluehlampen mbH, Munich (DE)

( * ) Notice: Subject to any disclaimer, the term of this patent is extended or adjusted under 35 U.S.C. 154(b) by 0 days.

(21) Appl. No.: 09/910,786

(22) Filed: Jul. 24, 2001

(65) Prior Publication Data

US 2002/0047602 A1 Apr. 25, 2002

(30) Foreign Application Priority Data

Jul. 28, 2000 (DE) ..... 100 36 952

(51) Int. Cl.[7] ..... H05B 37/00
(52) U.S. Cl. ..... 315/243; 315/242; 315/244

(58) Field of Search ..... 315/227 R, 242, 315/243, 244, 224, 225

(56) References Cited

U.S. PATENT DOCUMENTS

| | | | | | |
|---|---|---|---|---|---|
| 3,942,069 | A | * | 3/1976 | Kaneda | 315/244 |
| 4,808,888 | A | * | 2/1989 | Wyner et al. | 315/240 |
| 4,847,537 | A | * | 7/1989 | Ueda et al. | 315/243 |
| 5,821,696 | A | * | 10/1998 | Fromm et al. | 315/225 |

* cited by examiner

*Primary Examiner*—Don Wong
*Assistant Examiner*—Hoang Nguyen
(74) *Attorney, Agent, or Firm*—Carlo S. Bessone

(57) ABSTRACT

An electronic operating device for discharge lamps is disclosed in which an output terminal is connected via a coupling capacitor (CB) to a reference potential (E). An electric component (VC) which acts as a voltage source is inserted in series with the coupling capacitor (CB) in order to reduce the potential of an output terminal. The electric component (VC) consists in one embodiment of an inductor which is coupled to the lamp inductor.

3 Claims, 2 Drawing Sheets

REDUCING THE CLAMPING VOLTAGE OF OPERATING DEVICES FOR GAS DISCHARGE LAMPS

TECHNICAL FIELD

The invention proceeds from an electronic operating device for gas discharge lamps in accordance with the preamble of claim 1. What is involved here is, in particular, switching topologies which reduce the potential of at least one output terminal (2, 3) with respect to the earth potential. Output terminals are to be understood as the terminals of an operating device to which lamps are connected. If no further details are given with reference to a potential, potentials are taken to be referred to earth potential.

PRIOR ART

The potentials of the output terminals of an electronic operating device for gas discharge lamps should be kept as small as possible for the following reasons: firstly, an insulating problem ensues if an output terminal is at an excessively high potential. Leakage currents toward the earth potential which are no longer tolerable can arise; the protection against touching of the devices may in some circumstances no longer be ensured. Since the level of the potential of an output terminal is also a safety-relevant variable, its root-mean-square value is limited by the IEC Standard 60928.

Secondly, at high frequencies a high potential of an output terminal causes severe cable-conducted common-mode interference on the power leads. The lower this potential is, the less must be expended on radio interference suppression.

It is assumed that the potential difference between two points is determined by r.m.s. measurement of the voltage between the points. It is permissible in the following considerations to start from two lamp connections which are connected to the output terminals (2, 3) of the operating device. Of the usual four connections for lamps with heated filaments, respectively two which are connected by one filament are at approximately the same potential. The lamp arc voltage required for the lamps to be operated is present between the two significant lamp connections. The higher potential of the two output terminals (2, 3) is critical with reference to the above-described problem. The problem is compounded with rising lamp arc voltage. In particular, modern low-pressure discharge lamps with a diameter of 16 mm have an increased lamp arc voltage by comparison with conventional lamps with 26 mm. In the case of operating devices for two lamps, it has so far not been possible to connect said 16 mm lamps in series, since in the case of series connection the doubled lamp arc voltage causes the potential of at least one output terminal to exceed permitted limited values with respect to the earth potential. The prior art for solving this problem is therefore to be seen in the parallel connection of the lamps. However, when connecting the lamps in parallel it is necessary to provide a lamp circuit for each lamp, and this raises the costs, the weight and the space requirement of the device.

SUMMARY OF THE INVENTION

It is the object of the present invention to provide an operating device in accordance with the preamble of claim 1, in which the maximum of the potentials of the output terminals is as low as possible.

In the case of an operating device having the features of the preamble of claim 1, this object is achieved by the features of the characterizing part of claim 1. Particularly advantageous refinements are to be found in the dependent claims.

An electronic operating device for gas discharge lamps generally has an AC voltage generator (G) which makes available an AC voltage which has a frequency which is substantially higher than the frequency of the system voltage. The AC voltage is present mostly in a unipolar fashion at a generator output (1) with reference to a reference potential (E) which is close to the earth potential. The AC voltage is fed into a reactance network (Z) in order to transform the source resistance of the AC voltage generator (G) to a value which is suitable for operating the lamp. This provides a first output terminal (2) at which one or more series-connected lamps are connected. The second output terminal (3) leads to the reference potential (E) via the coupling capacitor (CB). The coupling capacitor bears the DC voltage component of the AC voltage source so that the lamp is operated with AC voltage free from DC voltage. It is frequently required for the coupling capacitor (CB) to be connected to a terminal at the reference potential (E) so that the voltage present at it can be better used by other components of the operating device.

Thus, the potential of at least one output terminal (2, 3) must be reduced in accordance with the object of the invention formulated above. As a rule, the first output terminal (2) has a higher potential, for which reason the latter must first and foremost be reduced. This is performed in accordance with the invention by inserting serially into the connection between the second output terminal (3) and the reference potential (E) an electric component (VC) which acts as a voltage source. The reduction voltage (UVC) formed thereat must have a voltage profile which is suitable for reducing the potential of the first output terminal (2). This condition can be observed, for example, by providing the electric component as a controlled voltage source. The control is then to be set such that the frequency of the reduction voltage (UVC) is equal to the frequency of the AC voltage generated by the AC voltage generator (G). Said controlled voltage source can be implemented in a particularly cost-effective way by means of coupled coils.

Of course, the abovenamed measures must not allow the potential of the second output terminal (3) to exceed the potential of the first output terminal (2). Potentials of the output terminals (2, 3) are equal in the ideal case.

DESCRIPTION OF THE DRAWINGS

The invention is to be explained in more detail below with the aid of a plurality of exemplary embodiments. In the drawing:

FIG. 1 shows the series circuit of an AC voltage generator (G), a reactance network (Z), a lamp (LP), an electric component (VC) acting as a voltage source, and a coupling capacitor (CB). The AC voltage generator (G) feeds its voltage between the generator output (1) and the reference potential (E). The reactance network (Z) is essentially connected between the generator output (1) and the first output terminal (2). As indicated by dashes, the reactance network (Z) can also have connections to the reference potential (E) and to the second output terminal (3). The lamp (LP) is connected between the first output terminal (2) and the second one (3). Instead of one lamp (LP), it is also possible to operate a plurality of lamps in series. The series circuit of the coupling capacitor (CB) and an electric component (VC) which acts as a voltage source is connected between the second output terminal (3) and the reference potential (E)

Figure 1:
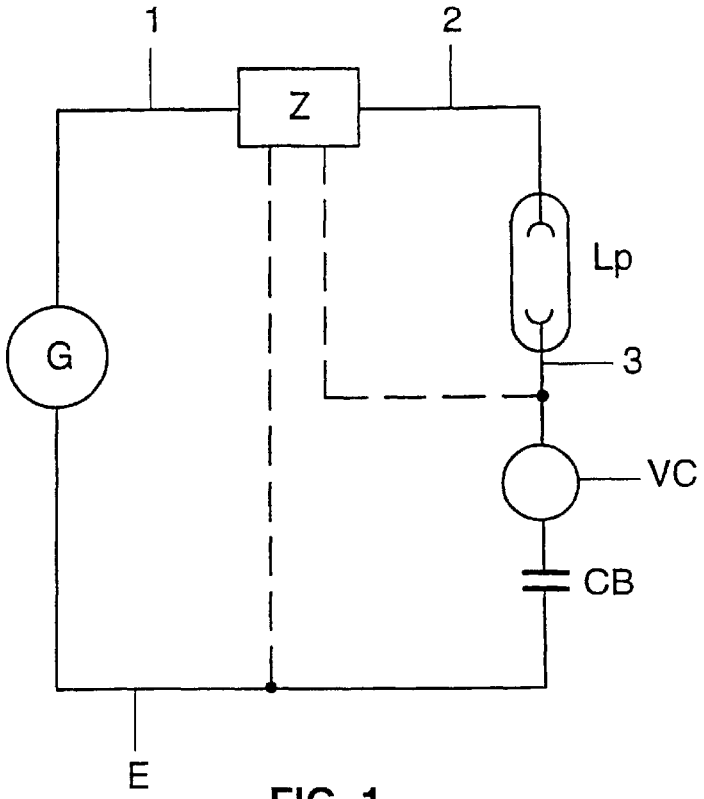
FIG. 1: shows a generalized circuit diagram for using the invention to implement an operating device for discharge lamps having a low potential of the output terminals (2, 3)
Figure 2:
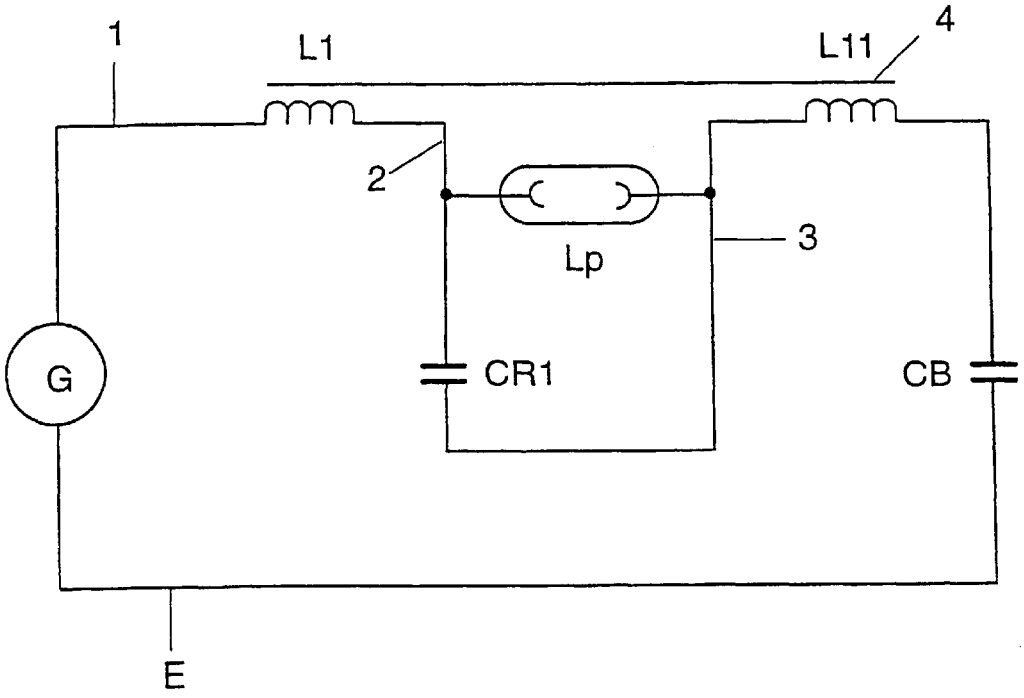
FIGS. 2, 3, 4: show special exemplary embodiments of the general approach to a solution in FIG. 1.

The generalized components in FIG. 1 are shown in more detail in FIG. 2. The reactance network (Z) now consists of a lamp inductor (L1) and a resonance capacitor (CR1). The lamp inductor (L1) is connected between the generator output (1) of the AC voltage generator (G) and the first output terminal (2). The resonance capacitor (CR1) is connected in parallel with the lamp (LP). The electric component (VC) is designed as a coupled inductor (L11). The coupling to the lamp inductor (L1) is indicated by the common core (4). The coupled inductor (L11) acts like a voltage source controlled by the voltage via the lamp inductor (L1) The coupling between the lamp inductor (L1) and the coupled inductor (L11 is designed such that the potential of the first output terminal (2) is reduced. The value of the inductance of the lamp inductor (L1) and of the coupled inductor (L11) is selected so as to set a desired lamp current given a specific voltage output by the AC voltage generator (G).

Figure 3:
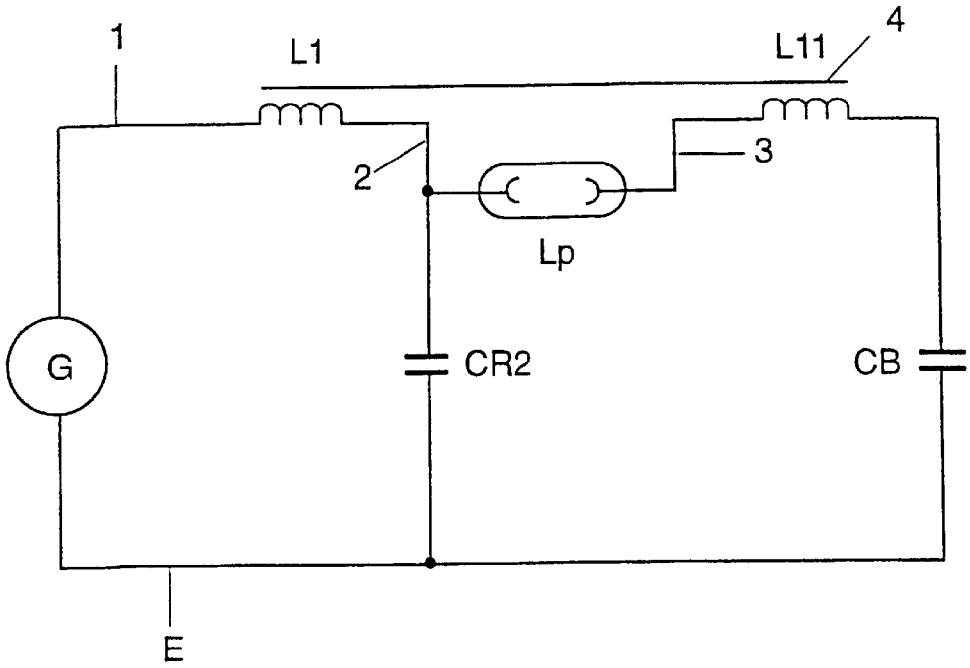

In FIG. 3, the reactance network (Z) is modified by comparison with FIG. 2. The resonance capacitor (CR2) is now connected between the first output terminal (2) and the reference potential (E). In some circumstances, this can result in better potential conditions with reference to starting the lamp. The remaining topology is identical to that in FIG. 2. The remarks relating to FIG. 2 also apply correspondingly.

Figure 4:
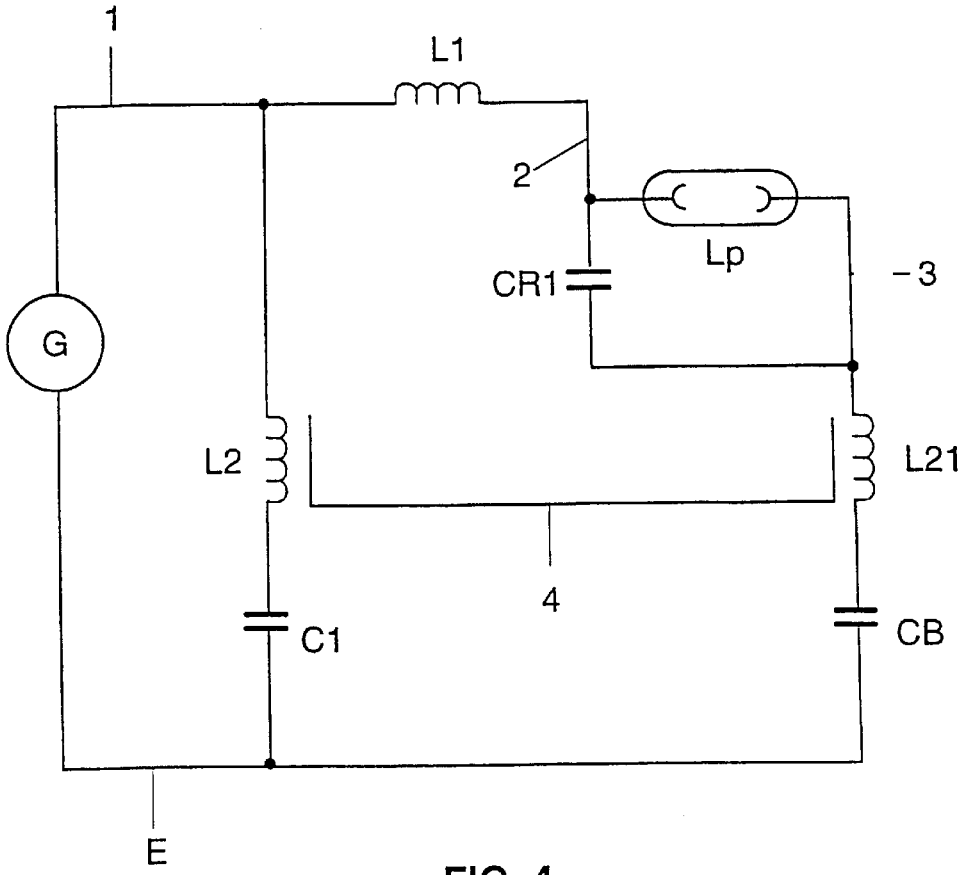

By comparison with FIG. 2, in FIG. 4 the series circuit of an inductor (L2) and a capacitor (C1) is added in parallel with the AC voltage generator (G). The coupled inductor (L21) is no longer, as in FIG. 2 (L11), coupled to the lamp inductor (L1), but is coupled to the newly added inductor (L2). The capacitor (C1) blocks off any DC voltage components of the AC voltage source (G). The increased outlay contributes a degree of freedom: the lamp inductor (L1) can now be dimensioned independently of the potential reduction of an output terminal (2, 3). The remarks relating to the functional principle from the description relating to FIGS. 1 and 2 are valid correspondingly. A further possibility for modifying the embodiments consists in that by analogy with FIG. 3 in FIG. 4 the resonance capacitor (CR1) is connected to the reference potential (E) instead of to the second output terminal (3).

What is claimed is:

1. Electronic operating device for gas discharge lamps which has the following features:

an AC voltage generator (G) which makes an AC voltage available between a generator output (1) and a reference potential (E), a reactance network (Z) which is connected to the generator output (1) and which provides a first output terminal (2) to which one or more series-connected discharge lamps (LP) are connected, a series circuit of a coupling capacitor (CB) and an electric component (VC) via which the lamp circuit is connected from a second output terminal (3) to the reference potential (E), and a reduction voltage (UVC) which is formed at the two poles of the electric component (VC), the voltage profile of the reduction voltage (UVC) being characterized in that it reduces the root-mean-square value of the voltage between at least one output terminal (2, 3) and the reference potential (E).

2. Electronic operating device for gas discharge lamps according to claim 1, characterized in that the reactance network (Z) includes a lamp inductor (L1) which is connected between the generator output (1) and the first output terminal (2), and the electric component (VC) includes in series with the coupling capacitor (CB) a coupled inductor (L11) which is coupled to the lamp inductor (L1) in such a way that the root-mean-square value of the voltage is reduced between the first output terminal (2) and the reference potential (E).

3. Electronic operating device for gas discharge lamps according to claim 1, characterized in that a primary coil (L2) is connected between the generator output (1) and the reference potential (E), the electric component (VC) includes a secondary coil (L21) in series with the coupling capacitor (CB), and an inductive coupling exists between the primary coil (L2) and the secondary coil (L22) in such a way that the root-mean-square value of the voltage is reduced between the first output terminal (2) and the reference potential (E).

* * * * *